United States Patent [19]

Azadian et al.

[11] 4,030,155

[45] June 21, 1977

[54] CLOG SOLE

[76] Inventors: Jacques Azadian, 84 N. Adams St., Manchester, N.H. 03104; Albert J. Arsenault, P.O. Box 571, Bethlehem, N.H. 03574

[22] Filed: Aug. 24, 1976

[21] Appl. No.: 717,256

[52] U.S. Cl. ..... 12/146 B; 36/86

[51] Int. Cl.² ..... A43D 00/00; A43B 1/06

[58] Field of Search ..... 12/146 B, 142 S; 36/11.5, 86

[56] References Cited

UNITED STATES PATENTS

| | | | |
|---|---|---|---|
| 2,364,691 | 12/1944 | Cagney | 12/146 B |
| 2,394,704 | 2/1946 | Loewer | 12/146 B |

FOREIGN PATENTS OR APPLICATIONS

| | | | |
|---|---|---|---|
| 2,265,252 | 10/1975 | France | 36/86 |

*Primary Examiner*—Patrick D. Lawson
*Attorney, Agent, or Firm*—Lee A. Strimbeck

[57] ABSTRACT

A method of manufacturing a segmented clog sole comprising the steps of forming a thick unit sole having a plurality of transverse slots on the mid sole side running across the width of but not through said unit sole, applying an adhesively attached mid and outer sole to the unit sole and then extending or cutting said slots completely through the outer sole and unit sole up to but not through said mid sole.

8 Claims, 3 Drawing Figures

CLOG SOLE

THIS INVENTION

This invention relates to a method of manufacturing a segmented sole for clog shoes.

This invention provides a clog sole that allows greater comfort by eliminating rubbing and permits a more natural walking motion by bending with the foot. This method of segmenting the clog sole also reduces the "clunkiness" of the sole. In use, the sole does not strike the walked-on surface as one rigid solid piece.

These and other objects are accomplished by forming a segmented clog sole in such a fashion that the mid sole is allowed to bend freely. Such bending is designed to relieve stress as well as the clunky nature of the sole, particularly at the ball of the foot. A transverse slot through the sole is positioned at the approximate area of the ball of the foot. Another such slot is located in the area of the toes. The use of two slots is preferred and usually no more than four will be used.

A mid sole and outer sole are preferably bonded to the unit sole in the usual manner by fast-curing, low-solvent adhesives well known in the shoe industry. The strength and permanency of of such adhesive bonds are negligibly impaired by water and normal wear. While the outer sole is cut through in forming the transverse slots in the unit sole, the mid sole is not and serves as a "hinge" for the unit sole segments.

In brief compass, the method of manufacturing the segmented clog sole of this invention comprises:

a. forming a unit sole of considerable thickness and having at least two slots on the upper side thereof running across the width of the unit sole perpendicular to the longitudinal axis thereof, one of the slots being approximately in the area of the ball and the others being forward thereof towards the toe;

b. applying with an adhesive a mid sole to the upper side of the thus scored unit sole and an outer sole to the bottom side thereof; and c. cutting the unit sold and outer sole completely through from the side of said outer sole into the slots with the cuts being in register with and in number corresponding to the slots.

As such segmenting has its greatest advantage with relatively thick soles, the unit sole has preferably a thickness of at least ½ inch in the area of the ball. Usually, the slots are at least 1/16 inch deep but no deeper than three quarters of the thickness of the unit sole, are at least 1/64 inch wide and are spaced to form approximately equal segments ± ¼ inch from the slot at the ball to the toe.

It might be noted that it is the nature of the industry to make such unit soles in one location and ship them to another for attachment of the uppers. The present method of manufacture is suited to this type of assembly.

THE DRAWINGS

The drawings depict the clog shoe sole of this invention and the method of making it. In the drawings:

FIG. 1 in perspective view shows a unit sole with two slots or indents on the upper side.

In the drawings, like parts have been given the same numbers through out in the interests of simplicity.

DESCRIPTION

Figure 1:
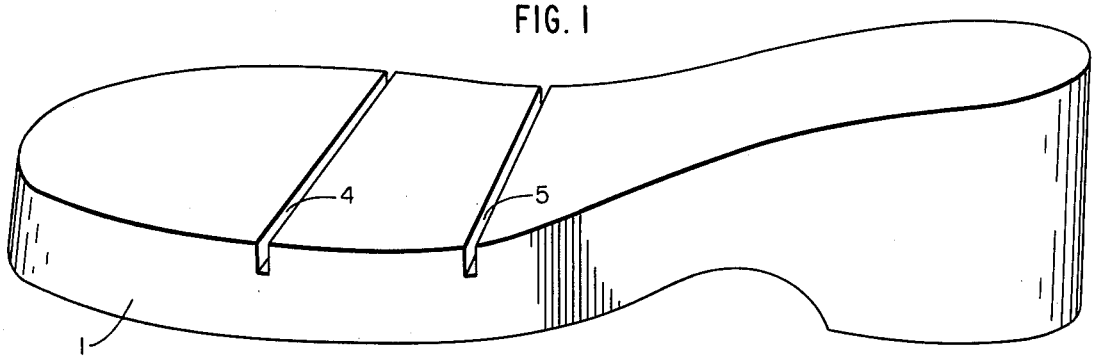
Figure 2:
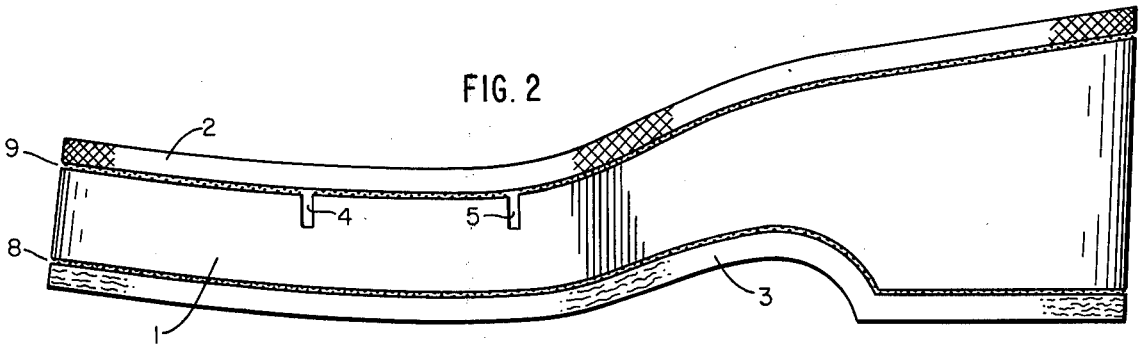
FIG. 2 shows the same sole with an adhesive attached mid sole and outer sole.

Referring to FIG. 1, the unit sole 1 is formed of a durable usually monolithic material such as metal (cost aluminum), cork wood, plastic (foamed polyurethane), a natural or synthetic rubber or other suitable material. On occasion it can be of a composition or laminated construction, e.g. laminated wood. Sole 1 contains two slots, 4 and 5, running across the width of the sole. The slots can be saw cut, stamped or molded in place depending on the material used to form the unit sole. It is not necessary that the two slots be of equal size (width and/or depth) nor need they be rectangular in cross-section as shown, e.g. they can be U- or V-shaped. They are preferably at least 1/16 inch deep but no deeper than three quarters of the thickness of the sole.

FIG. such as is a side view of the unit sole 1 containing slots 4 and 5, a mid sole 2 and an outer sole 3. The outer sole 3 is conventional and constructed of a material such leather, neoprene rubber, or a crepe rubber. It is bonded to the unit sole 1 by means of an adhesive 8, preferably of the thermoset type, e.g. butyl rubber-solvent type or a polyamide hot melt type. The mid sole 2 is preferably leather or some equally rugged nonextensible but flexible material such as a cloth reinforced synthetic rubber or a rubber impregnated nonwoven. It is bonded to unit sole 1 by a known adhesive 9 such as above described with 8.

Figure 3:
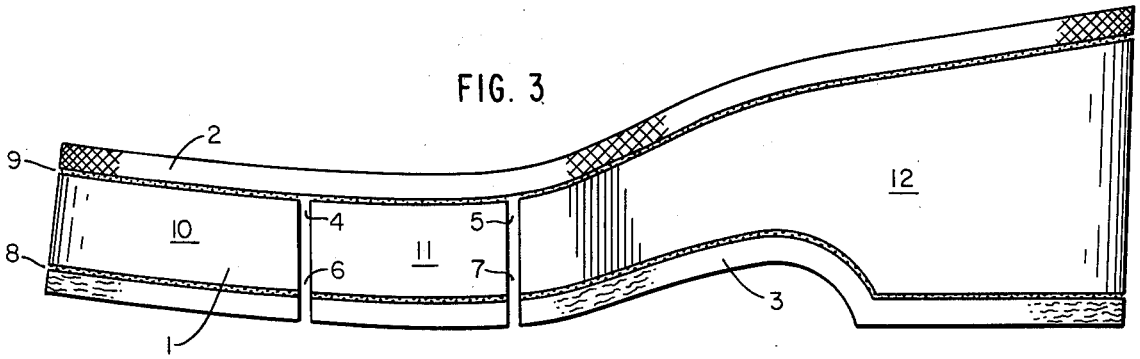
FIG. 3 shows the unit sole and outer sole completely cut through along the lines of the original slots to the mid sole.

FIG. 3 is a side view of the completed sole wherein the unit sole 1 and outer sole 3 bonded by adhesive 8 have been cut through in the line of the slots 4 and 5 to form three segments 10, 11 and 12 that are attached to and held together by mid sole 2 via adhesive 9. Slots 4 and 5 are extended by cutting through outer sole 3 and unit sole 1 with newly cut slots 6 and 7, respectively, from the outer sole side.

In the manufacture of soles of this type they are usually mounted for the attachment of the outer sole on a tool or anvil supporting the sole in the approximate area of the heel with the bottom side up. After attaching sole 3, the anvil can be also used to hold the clog sole for cutting with registration of the cuts being easily accomplished by reference to the anvil. Cutting will usually be done with a saw so as to remove some material and leave a definite space. However, slicing, breaking and the like can on occasion be used. Preferably the slots are gapped at least 1/64 inch.

The clog sole 1 is preferably at least ½ inch thick as it is with the thicker soles that this invention offers its most advantages. Usually the slots run completely through the clog sole on a line perpendicular to the longitudinal axis of the sole. While one slot is preferably located at the ball of the foot, the others can be spaced forward thereof as desired. If only two slots are used, the second slot is preferably spaced to form equal segments ± ¼ inch between the ball slot and the toe.

Uppers are attached to the clog sole by any desired method such as cementing or slip lasting, California type attachment, staples, tacking and the like. The uppers can be of any desired style, e.g. sandals, sabots, boots, etc.

As can be appreciated, the clog sole manufactured by this method with the characteristics herein described allows greater bendability and flexibility of the clog sole in its entirety and reduces the clunkiness of the soles.

In addition and of importance, the method of manufacturing the sole allows ease of manufacture as well as speed in that the final segmentation of the sole is accomplished by cutting the assembled sole rather than attempting to manufacture and assemble the sole by combining separate pieces.

What is claimed is:

1. A method of manufacturing a segmented clog sole comprising:

a. forming a unit sole having at least two slots on the upper side thereof running across the width of said unit sole perpendicular to the longitudinal axis thereof, one of said slots being approximately in the area of the ball and the others being forward thereof towards the toe;

b. applying with an adhesive a mid sole to the upper side of said unit sole over said slots and an outer sole to the bottom side thereof; and c. cutting said unit sole and outer sole completely through from the side of said outer sole into said slots with the cuts being in register with and in number corresponding to said slots.

2. The process of claim 1 wherein said unit sole has a thickness of at least ½ inch in the area of the ball, said slots are at least 1/16 inch deep but no deeper than three quarters of the thickness of said unit sole, are at least 1/64 inch wide and are spaced to form approximately equal segments ± ¼ inch from said one slot to the toe.

3. The process of claim 1 wherein the number of said slots does not exceed four.

4. The process of claim 1 wherein an upper is fastened to said unit sole prior to step (c).

5. The process of claim 1 wherein an upper is fastened to to said unit sole after step (c).

6. A clog made by the process of claim 1.

7. A method of manufacturing a clog sole comprising:

forming a unit sole from a monolithic material and applying thereto with an adhesive a flexible mid sole to the upper side and an outer sole to the bottom side, and cutting said unit sole and outer sole completely through from the side of said outer sole with the cuts running across the width of said unit sole generally perpendicular to the longitudinal axis thereof, one of the cuts being approximately in the area of the ball and the others being forward thereof towards the toe and spaced to give approximately equal segments, said segments being held together by said mid sole.

8. A shoe incorporating the clog sole produced by the process of claim 7.

* * * * *